United States Patent [19]

Kinzig

[11] Patent Number: 4,620,740

[45] Date of Patent: Nov. 4, 1986

[54] CABINET FOR THE STORAGE AND CARRYING OF RECORD ALBUMS

[76] Inventor: Michael Kinzig, 2260 Cahuenga Blvd., Los Angeles, Calif. 90068

[21] Appl. No.: 824,455

[22] Filed: Jan. 31, 1986

[51] Int. Cl.[4] ..... A47B 81/06; B65D 71/00

[52] U.S. Cl. ..... 294/159; 211/40; 211/194; 312/10; 294/143; 294/169

[58] Field of Search ..... 294/137, 141-143, 294/146, 159-163, 167, 169; 16/126; 206/309, 311, 387, 444, 509, 511; 211/40-42, 184, 188, 194; 312/9, 10, 12, 13, 15

[56] References Cited

U.S. PATENT DOCUMENTS

| | | | |
|---|---|---|---|
| 2,332,193 | 10/1943 | Beder | 312/12 |
| 2,402,746 | 6/1946 | Goldich | 312/10 |
| 2,760,839 | 8/1956 | Martin | 312/10 |
| 2,765,111 | 10/1956 | Vaughn | 294/169 |
| 3,168,229 | 2/1965 | Heifetz | 294/137 |
| 4,196,812 | 4/1980 | McInnis | 211/40 |

FOREIGN PATENT DOCUMENTS

| | | | |
|---|---|---|---|
| 201331 | 2/1939 | Switzerland | 312/12 |
| 206330 | 11/1923 | United Kingdom | 312/10 |
| 341702 | 1/1931 | United Kingdom | 312/12 |

*Primary Examiner*—Johnny D. Cherry
*Attorney, Agent, or Firm*—Norman B. Rainer

[57] ABSTRACT

A cabinet for the storage and carrying of a plurality of phonograph record albums in non-warping disposition is comprised of a box-like structure having top, bottom, rear and side panels and having a pivoted, fold-away carrying handle and open front extremity. The carrying handle is positioned in the top panel such that the center of gravity of the cabinet is rearward of the handle. The combined effect of the position of the handle and its pivoted nature causes the open front extremity of the cabinet to be angled upwardly when the cabinet is carried by the handle. Several such cabinets may be stacked in stabilized configuration because of the fold-away characteristic of the handle, and interengaging depressions and projections in the upper and lower panels.

6 Claims, 5 Drawing Figures

CABINET FOR THE STORAGE AND CARRYING OF RECORD ALBUMS

BACKGROUND OF THE INVENTION

This invention relates to the field of record album cabinets, and more particularly concerns cabinets for holding a plurality of phonograph records usually stored in a record jacket and wherein these record albums are easily selectable and returnable to the cabinet.

Numerous types of record holding devices have earlier been disclosed. In general, the devices provide for aligned parallel storage of the records within their protective jackets of square periphery. It is important that, in any such storage, the records be maintained in an unstressed vertical or horizontal position to avoid warping. Efficient packing density of the albums is desirable, but should not interfere with the locating, removal and replacement of stored albums.

It is desirable that the storage cabinet have the further feature of permitting safe and easy transport of the records. Although a large collection of records may not be readily carried by hand because of weight and size considerations, it is desirable to have a record storage system capable of adjustably accommodating a large number of records, yet with provisions for transportively carrying selected portions of the collection.

It is accordingly an object of the present invention to provide a protective enclosure for the orderly storage of a number of phonograph record albums.

It is a further object of this invention to provide a cabinet which holds said albums in a substantially vertical and non-warping position.

It is another object of the present invention to provide a cabinet of the aforesaid nature amenable to convenient hand-carrying.

It is a still further object of this invention to provide a cabinet of the aforesaid nature of modular design capable of nested engagement with other like cabinets.

It is yet another object of the invention to provide a cabinet of the aforesaid nature of rugged, durable construction amenable to low cost manufacture.

These objects and other objects and advantages of the invention will be apparent from the following description.

SUMMARY OF THE INVENTION

The above and other beneficial objects and advantages are accomplished in accordance with the present invention by a storage and carrying cabinet comprising:

(a) top and bottom panels, opposed side panels, and a rear panel, said panels being rigid, rectangular and interconnected to form a box-like enclosure having an open front extremity defined by the forward edges of said top, bottom and side panels, said panels being further characterized in having substantially flat interior and exterior faces, (b) U-shaped handle means associated with the exterior face of said top panel and pivotably attached thereto at two sites centered upon a line that perpendicularly intersects said side panels at sites located closer to said open front extremity than said rear panel, said handle means being adapted to swing in a vertical path between a carrying mode upright from said top panel and a storage mode below the exterior face of said top panel, (c) an upper series of straight parallel uniformly spaced retaining shoulders disposed upon the interior face of said top panel in an orientation directed between said rear panel and open front extremity, and extending downwardly within said enclosure, (d) a lower series of straight parallel uniformly spaced retaining shoulders disposed upon the interior face of said bottom panel and extending upwardly within said enclosure in a vertical alignment with the shoulders of said upper series, and (e) interengaging means associated with the exterior faces of said top and bottom panels in a manner permitting one cabinet to be stacked upon another in a condition resistant to sliding movement, whereby (f) phonograph record albums of equal size can be slidably inserted through said open front extremity into abutting engagement with the interior face of said rear panel and held in substantially vertical disposition by matching upper and lower shoulders, and (g) when carried by said handle means, said open front extremity is automatically tilted upwardly, thereby preventing discharge of the albums from the cabinet.

In preferred embodiments of the invention, the panels are fabricated of molded plastic. The top panel and associated retaining shoulders may be a single monolithic molded member. Likewise, the bottom panel and its associated retaining shoulders may be a single monolithic member. In another preferred embodiment, the forward edge of the top panel is displaced rearwardly with respect to the forward edge of the underlying bottom panel, thereby facilitating insertion of said albums into the cabinet. The interior height of the cabinet, measured perpendicularly between the interior faces of the top and bottom panels, is preferably just slightly greater than the height of the albums. The interengaging means may be in the form of concave circular depressions in the exterior face of the top panel, and aligned matching convex circular projections on the exterior face of the bottom panel.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

Figure 1:
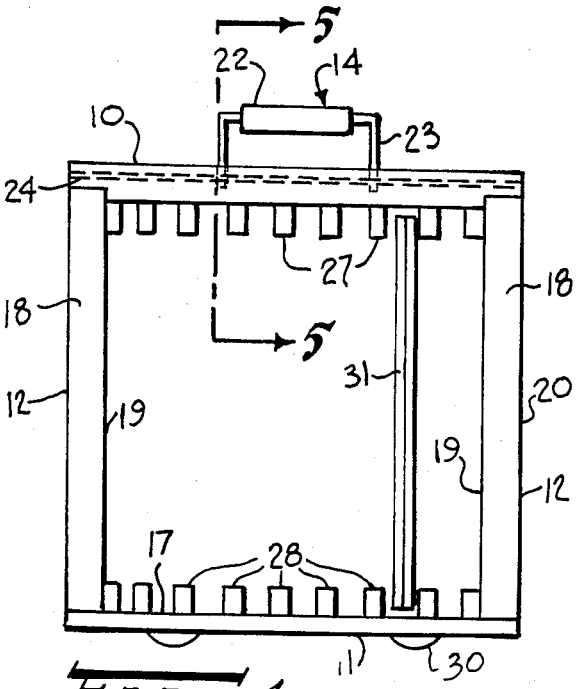
FIG. 1 is a front view of an embodiment of the cabinet of this invention with the handle means shown in its upright, carrying mode.
Figure 3:
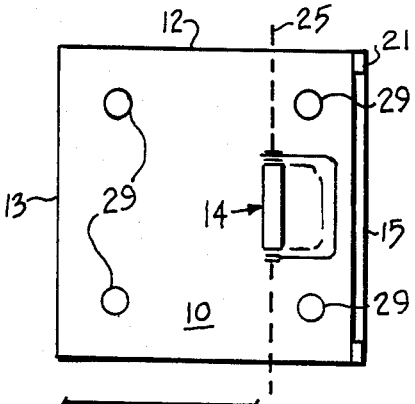
FIG. 3 is a top view of the cabinet of FIG. 1.
Figure 4:
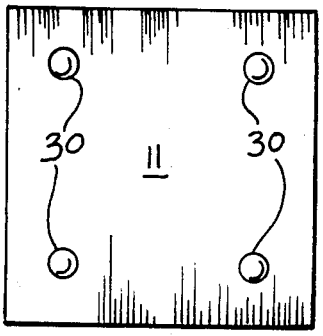
FIG. 4 is a bottom view of the cabinet of FIG. 1.

For convenience of description, the expressions "upper" and "lower" and terms of equal import will have reference to the upper and lower portions, respectively, of the cabinet as shown in FIG. 1. Similarly, the terms "front" and "rear" and equivalents thereof will have reference to the right and left portions, respectively, of the cabinet as shown in FIG. 3.

DESCRIPTION OF THE PREFERRED EMBODIMENT

Referring to the drawing, an embodiment of the cabinet of the present invention is shown comprised of top and bottom panels 10 and 11, respectively, opposed side panels 12, and rear panel 13 interconnected to form a rectangular box-like enclosure, and carrying handle 14 attached to said top panel.

The panels are of rigid construction and rectangular perimeter. The enclosure has an open front extremity 15 defined by the forward edges 16, 17, and 18, respectively, of said top, bottom and side panels. Each panel is further characterized in having substantially flat interior and exterior faces, 19 and 20, respectively. The panels are joined in perpendicular relationship by conventional fastening means, or may be continuous portions of a monolithic structure. The panels are preferably fabricated of a strong, light-weight plastic such as polypropylene, ABS resin and other thermoplastic resins well suited for molding fabrication techniques. The five panels are of substantially identical square shape except for top panel 10 which may be slightly shorter in its rear-to-front direction, thereby forming an access notch 21 which facilitates insertion of record albums into the cabinet.

Figure 2:
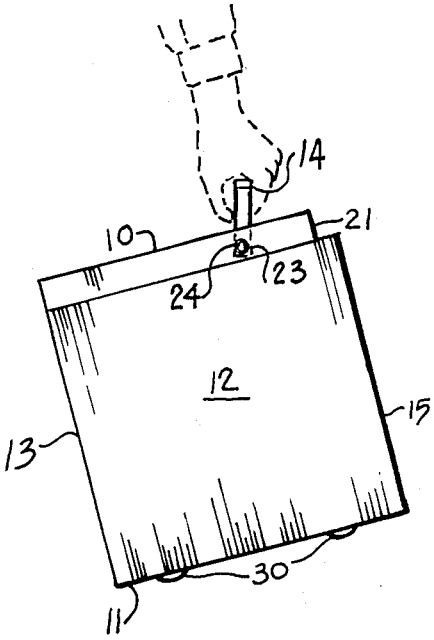
FIG. 2 is a side view of the cabinet of FIG. 1 shown in its carrying mode.
Figure 5:
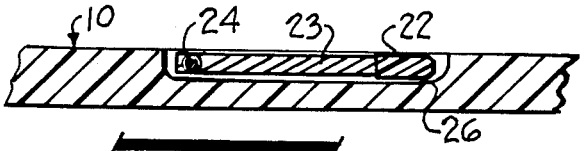
FIG. 5 is an enlarged fragmentary sectional view taken along the lines 5—5 of FIG. 1, and showing the handle in its storage mode.

The exemplified handle means is comprised of a gripping portion 22 disposed in parallel relationship to top panel 10, and opposed arms 23 having lower extremities attached by pivot rod 24 to said top panel. Said pivot rod passes through a close-fitting channel in top panel 10, and is centered upon a line 25 that perpendicularly intersects side panels 12 at sites located closer to said open front extremity than said rear panel. The handle is adapted to swing in a vertical path between a carrying mode upright from the top panel, as shown in FIGS. 1–3, and a storage mode, as shown in FIG. 5, wherein the handle fits into a recess 26 within the exterior face of said top panel. The location of the pivot rod is such that the center of gravity of the cabinet is between the handle and rear panel. Accordingly, when the cabinet is carried, as shown in FIG. 2, open front extremity 15 is automatically tilted upwardly. In some embodiments, the handle may be removably associated with said top panel.

An upper series of retaining shoulders 27 is perpendicularly affixed to the interior face of said top panel. The shoulders are elongated straight structural elements of uniform cross-sectional configuration in parallel, uniformly spaced relationship and extending between said rear panel and open front extremity. The shoulders have a height between about $\frac{1}{4}''$ and $1''$ measured as their downward extension into the interior of the cabinet.

A lower series of retaining shoulders 28 is perpendicularly affixed to the interior face of said bottom panel in vertical alignment with said upper retaining shoulders. The shoulders of said upper and lower series are of substantially equal size and shape.

Upper interengaging means in the form of concave circular depressions 29 are positioned within the exterior face of the top panel. Lower interengaging means in the form of convex circular projections 30 adapted to conform with said concave depressions are located in the exterior surface of said bottom panel and in alignment with said concave depressions.

By virtue of the specialized construction and features of the cabinet of this invention, record albums 31 may be slidingly entered into the open front extremity and held in substantially vertical disposition by said upper and lower shoulders. Because of the stacking nature of the cabinet, a large record collection can be accommodated, yet a desired portion of the collection can be conveniently and safely transported.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A cabinet for the storage and carrying of a plurality of phonograph record albums in closely packed non-warping disposition while permitting easy location, removal and re-entry of said albums, said cabinet comprising:

(a) top and bottom panels, opposed side panels, and a rear panel, said panels being rigid and rectangular and interconnected to form a box-like enclosure having an open front extremity defined by the forward edges of said top, bottom and side panels, said panels being further characterized in having substantially flat interior and exterior faces, (b) U-shaped handle means associated with the exterior face of said top panel and pivotably attached thereto at two sites centered upon a line that perpendicularly intersects said side panels at sites located closer to said open front extremity than said rear panel, said handle means being adapted to swing in a vertical path between a carrying mode upright from said top panel and a storage mode wherein said handle means is below the exterior face of said top panel, (c) an upper series of straight parallel uniformly spaced retaining shoulders disposed upon the interior face of said top panel, elongated between said rear panel and open front extremity, and extending downwardly within said enclosure, (d) a lower series of straight parallel uniformly spaced retaining shoulders disposed upon the interior face of said bottom panel and extending upwardly within said enclosure in vertical alignment with the shoulders of said upper series, and (e) interengaging means associated with the exterior faces of said top and bottom panels in a manner permitting one cabinet to be stacked upon another in a condition resistant to sliding movement, whereby (f) phonograph record albums of equal size can be slidably inserted through said open front extremity into abutting engagement with the interior face of said rear panel and held in substantially vertical disposition by matching upper and lower shoulders, and (g) when carried by said handle means, said open front extremity is automatically tilted upwardly, thereby preventing discharge of the albums from the cabinet.

2. The cabinet of claim 1 wherein the panels are fabricated of molded plastic.

3. The cabinet of claim 2 wherein said panels and associated retaining shoulders are portions of a single monolithic molded structure.

4. The cabinet of claim 1 wherein said interengaging means are comprised of depressions in the exterior face of said top panel, and aligned matching projections on the exterior face of said bottom panel.

5. The cabinet of claim 1 wherein a recess within the exterior face of said top panel accommodates said handle means in its storage mode.

6. The cabinet of claim 1 having an access notch associated with the forward edge of said top panel, said notch facilitating insertion of albums into the cabinet.

* * * * *